US005887234A

United States Patent [19]

Aslam et al.

[11] Patent Number: 5,887,234

[45] Date of Patent: Mar. 23, 1999

[54] REPRODUCTION APPARATUS PROVIDING SELECTABLE IMAGE QUALITY AND GLOSS

[75] Inventors: Muhammed Aslam, Rochester; Rodney R. Bucks; Borden H. Mills, both of Webster, all of N.Y.

[73] Assignee: Eastman Kodak Company, Rochester, N.Y.

[21] Appl. No.: 992,872

[22] Filed: Dec. 17, 1997

[51] Int. Cl.[6] ..... G03G 15/20

[52] U.S. Cl. ..... 399/322; 399/341; 399/400

[58] Field of Search ..... 399/320, 321, 399/322, 326, 327, 328, 329, 341, 342, 397, 400

[56] References Cited

U.S. PATENT DOCUMENTS

| | | | |
|---|---|---|---|
| 3,079,253 | 2/1963 | Greig . | |
| 4,772,532 | 9/1988 | Adair et al. . | |
| 4,791,447 | 12/1988 | Jacobs . | |
| 4,820,618 | 4/1989 | Lawson et al. . | |
| 4,828,950 | 5/1989 | Crandall . | |
| 4,859,561 | 8/1989 | Metz et al. . | |
| 4,928,148 | 5/1990 | Higashi . | |
| 5,004,891 | 4/1991 | Landis . | |
| 5,045,888 | 9/1991 | Imaeda | 399/341 |
| 5,089,363 | 2/1992 | Rimai et al. . | |
| 5,126,797 | 6/1992 | Forest et al. . | |
| 5,164,782 | 11/1992 | Nagayama et al. . | |
| 5,234,783 | 8/1993 | Ng . | |
| 5,256,507 | 10/1993 | Alsam et al. . | |
| 5,260,753 | 11/1993 | Haneda et al. | 399/341 X |
| 5,296,904 | 3/1994 | Jackson . | |
| 5,319,429 | 6/1994 | Fukuchi et al. . | |
| 5,327,201 | 7/1994 | Coleman et al. . | |
| 5,339,146 | 8/1994 | Aslam et al. . | |
| 5,339,148 | 8/1994 | Johnson et al. . | |
| 5,343,278 | 8/1994 | Nakabayashi et al. | 399/326 |
| 5,357,326 | 10/1994 | Cherian . | |
| 5,392,104 | 2/1995 | Johnson . | |
| 5,666,592 | 9/1997 | Aslam et al. | 399/329 X |

FOREIGN PATENT DOCUMENTS 0 081 887 12/1982 European Pat. Off. .

*Primary Examiner*—Sandra Brase
*Attorney, Agent, or Firm*—Lawrence P. Kessler

[57] ABSTRACT

A reproduction apparatus providing for selectable image quality and gloss. The reproduction apparatus as disclosed includes a dielectric member adapted to have latent images formed thereon. A development station for the reproduction apparatus includes a plurality of developer units respectively containing marking particles of different colors, at least one developer unit containing black marking particles and another developer unit containing clear marking particles, for selectively developing latent images on the dielectric member with marking particles from the developer units respectively. The developed marking particle images are transferred by a transfer station from said dielectric member to a receiver member. A fuser assembly includes a first fusing device for fusing a marking particle image on a receiver member so as to produce a low gloss image on the receiver member, and a second fusing device for fusing a marking particle image on a receiver member so as to produce a high gloss image on the receiver member. A transport, in juxtaposition with the transfer station, selectively communicates with the first fusing device or the second fusing device. A control selectively activates the developer unit for applying clear marking particles to a receiver member, and the transport to deliver a receiver member from said transfer station to said first or second fusing device dependent upon the desired quality and gloss of an image fused on a receiver member.

12 Claims, 3 Drawing Sheets

REPRODUCTION APPARATUS PROVIDING SELECTABLE IMAGE QUALITY AND GLOSS

CROSS REFERENCE TO RELATED APPLICATIONS

U.S. patent application Ser. No. 8/992,057, filed Dec. 17, 1997, entitled "BELT FUSING ACCESSORY WITH SELECTABLE FUSED IMAGE GLOSS" in the name of Muhammed Aslam et al.

U.S. patent application Ser. No. 8/992,643, filed Dec. 17, 1997, entitled "BELT FUSER APPARATUS FOR PREVENTING LINE ART TYPE MARKING PARTICLE OFFSET" in the name of Muhammed Aslam et al.

U.S. patent application Ser. No. 8/992,058, filed Dec. 17, 1997, entitled "APPLICATION OF CLEAR TONER DEVELOPED NEGATIVE TO THE IMAGE IN AN ELECTROPHOTOGRAPHIC PROCESS TO ELIMINATE IMAGE RELIEF AND DIFFERENTIAL GLOSS ARTIFACTS" in the name of William J. Staudenmayer et al.

U.S. patent application Ser. No. 8/992,746, filed Dec. 17, 1997, entitled "APPLICATION OF CLEAR MARKING PARTICLES TO IMAGES WHERE THE MARKING PARTICLE COVERAGE IS UNIFORMLY DECREASED TOWARDS THE EDGES OF THE RECEIVER MEMBER" in the name of Muhammed Aslam et al.

U.S. patent application Ser. No. 8/992,060, filed Dec. 17, 1997, entitled "COOLING AND REUSING THE HEAT TO PREHEAT THE FUSING WEB IN A BELT FUSER" in the name of Muhammed Aslam et al.

U.S. patent application Ser. No. 8/992,056, filed Dec. 17, 1997, entitled "MECHANISM FOR TRACKING THE BELT OF A BELT FUSER" in the name of Muhammed Aslam et al.

U.S. patent application Ser. No. 8/992,059, filed Dec. 17, 1997, entitled "A COLLAPSIBLE CUSTOMER REPLACEABLE BELT FUSER ASSEMBLY DESIGNED FOR ACCESSIBILITY, SERVICEABILITY, AND FUSING BELT REPLACEMENT" in the name of Muhammed Aslam et al.

U.S. patent application Ser. No. 8/992,745, filed Dec. 17, 1997, entitled "APPARATUS FOR PACKAGING AND INSTALLATION OF A FUSING BELT" in the name of Muhammed Aslam et al.

FIELD OF THE INVENTION

This invention is directed in general to reproduction apparatus of the type providing selectable image quality and gloss, and more particularly to reproduction apparatus having alternate fuser assemblies respectively optimized for fixing black or multi-color images to receiver members.

BACKGROUND OF THE INVENTION

In typical commercial electrostatographic reproduction apparatus (copier/duplicators, printers, or the like), a latent image charge pattern is formed on a uniformly charged charge-retentive or photo-conductive member having dielectric characteristics (hereinafter referred to as the dielectric support member). Pigmented marking particles are attracted to the latent image charge pattern to develop such image on the dielectric support member. The developed image is transferred to a receiver member, such as a sheet of paper, transparency or other medium, in an electric field. After transfer, the receiver member bearing the transferred image is transported away from the dielectric support member, and the image is fixed (fused) to the receiver member by heat and pressure to form a permanent reproduction thereon.

Certain reproduction apparatus have been designed to produce multi-color copies. In such reproduction apparatus, multiple color separation images are respectively developed with complementary colored marking particles, and then transferred in superposition to a receiver member. It has been found that fixing of multi-color marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impare legibility, a matte finish is preferred.

It is known that the glossiness of a marking particle image is, at least in part, dependent upon the marking particle melting characteristics in the fixing process. In general, the fixing apparatus serves to soften or at least partially melt the marking particles, enabling the marking particles to permeate into the fibers of the receiver member so that the marking particles are fixed to the receiver member to give a glossy image reproduction. For example, the fixing apparatus may include a heated roller which contacts the marking particles and the receiver member. With multi-color marking particle images, the multiple color marking particle images are respectively melted and fixed by the heated roller. If the color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy. Therefore low melting point marking particles are used. They yield few cavities and a hard flat surface so as to give glossy and vivid colors in the reproduction.

Low melting point marking particles are subject to increased image offset to the heating roller. This can produce undesirable defects in the reproduction or subsequent reproductions. Although image offset can be reduced by application of fuser oil to the heating roller, the use of such oil introduces further complications into the fusing system, such as handling of the oil and making sure that the layer of oil on the roller is uniform. Alternatively, a mechanical arrangement for reducing image offset, without the need for fuser oil, has been found. Such mechanical arrangement provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing, but is not particularly suitable for black image fusing.

In order to provide for both multi-color image fusing and black image fusing in a single reproduction apparatus, an arrangement has been proposed in U.S. Pat. No. 5,164,782 (issued Nov. 17, 1992, in the name of Nagayama et al). The fusing arrangement of this patent provides for selective use of a short fusing path for non-glossy fusing, and an elongated path for glossy fusing. However, since the same basic structure is utilized to provide the primary fusing (heating) function, the versatility of the arrangement for selective gloss on different types of receiver members with different physical characteristics is limited.

SUMMARY OF THE INVENTION

In view of the above, this invention is directed to a reproduction apparatus providing for selectable image quality and gloss. The reproduction apparatus as disclosed includes a dielectric member adapted to have latent images formed thereon. A development station for the reproduction apparatus includes a plurality of developer units respectively containing marking particles of different colors, at least one developer unit containing black marking particles and another developer unit containing clear marking particles, for selectively developing latent images on the dielectric member with marking particles from the developer units respectively. The developed marking particle images are transferred by a transfer station from said dielectric member to a receiver member. A fuser assembly includes a first fusing device for fusing a marking particle image on a receiver member so as to produce a low gloss image on the receiver member, and a second fusing device for fusing a marking particle image on a receiver member so as to produce a high gloss image on the receiver member. A transport, in juxtaposition with the transfer station, selectively communicates with the first fusing device or the second fusing device. A control selectively activates the developer unit for applying clear marking particles to a receiver member, and the transport to deliver a receiver member from said transfer station to said first or second fusing device dependent upon the desired quality and gloss of an image fused on a receiver member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
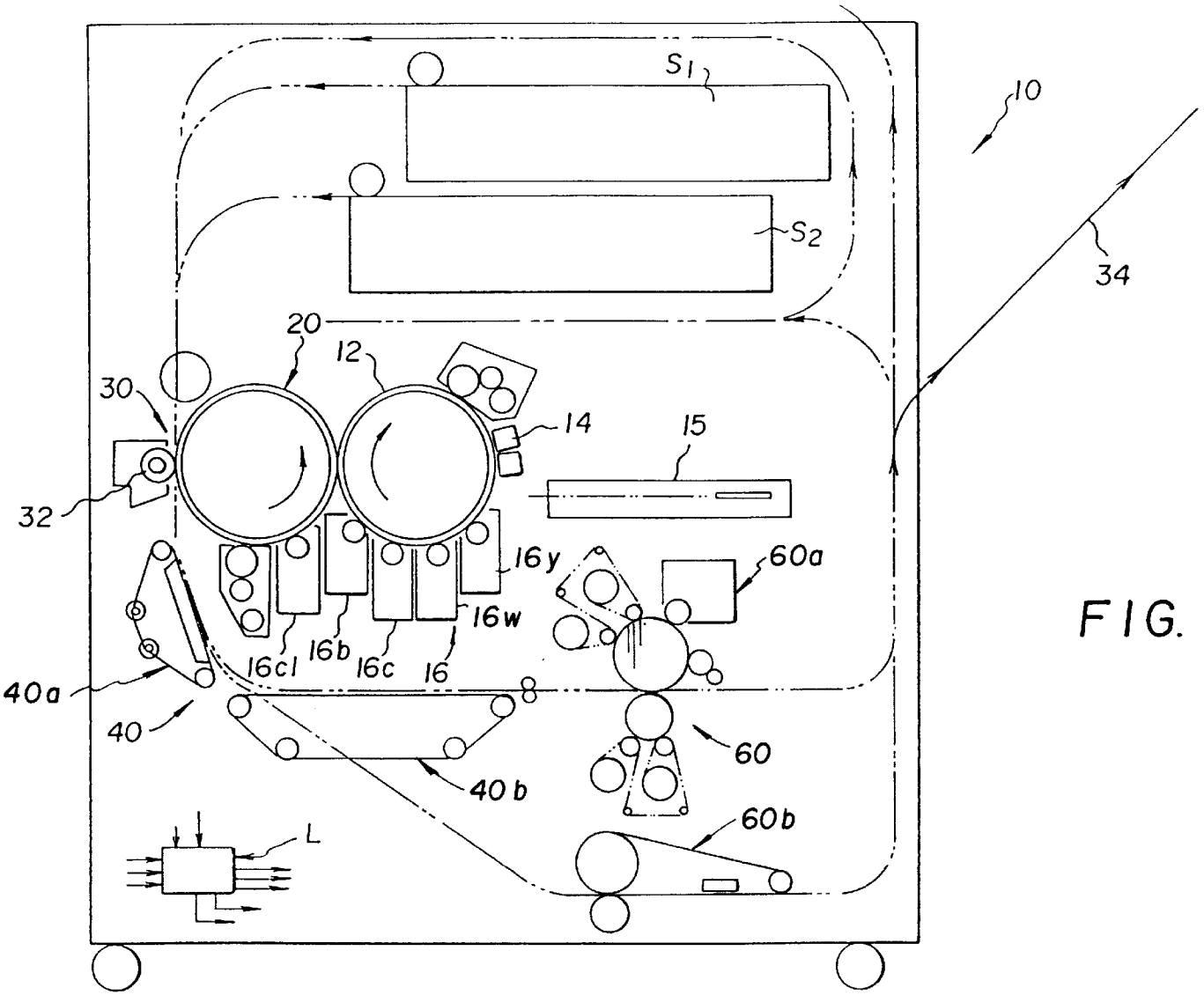
FIG. 1 is a front elevational view of an electrostatographic reproduction apparatus including a fuser assembly, according to this invention, for providing selectable image quality and gloss.

Referring now to the accompanying drawings, an electrostatographic reproduction apparatus, designated generally by the numeral 10, is shown in FIG. 1. The reproduction apparatus 10 includes a primary image forming dielectric member, for example, a drum 12 having a photoconductive surface, upon which a pigmented marking particle image, or series of different color marking particle images, is formed. In order to form images, when the drum 12 is rotated and the direction indicated by the associated arrow, the photoconductive surface of the drum is uniformly charged by a corona charging device 14. The uniformly charged surface is exposed imagewise by suitable exposure means, such as for example a laser 15 or light emitting diode (LED) array, to create a corresponding latent electrostatic image. The latent electrostatic image is developed by a application of pigmented marking particles to the image bearing drum 12 by a development station 16. The development station 16 may include from one to four (or more) separate developing units. In the embodiment of the reproduction apparatus 10 as shown, there are five developing units, each unit having particular different color marking particles associated respectively therewith. Specifically, developing unit 16*y* contains yellow marking particles, developing unit 16*m* contains magenta marking particles, developing unit 16*c* contains cyan marking particles, and developing unit 16*b* contains black marking particles. Of course, other color marking particles (e.g. red, green, blue, etc.) may be used in the particular developing units depending upon the overall arrangement of the development station 16 and operational characteristics of the color development scheme for the reproduction apparatus 10. Additionally, a developing unit 16*c*1 is provided, containing clear marking particles, which is utilized to aid in improving the quality and gloss of reproduced images, in the manner to be explained hereinbelow.

Each developer unit is separately activated for operative developing relation with drum 12 to apply different color marking particles respectively to a series of images carried on drum 12 to create a series of different color marking particle images. The developed marking particle image is transferred (or multiple marking particle images are transferred one after another in registration) to the outer surface of a secondary or intermediate image transfer member, for example, an intermediate transfer drum 20. Thereafter, the single marking particle image, or a multicolor image comprising multiple marking particle images respectively formed on the surface of the intermediate image transfer member drum 20, is transferred in a single step to a receiver member.

The receiver member is transported along a path (designated by chain-link lines) into a nip 30 between intermediate image transfer member drum 20 and a transfer backing member, for example a roller 32. The receiver member is delivered from a suitable receiver member supply (hopper $S_1$ or $S_2$) into nip 30 where it receives the marking particle image. The receiving member exits the nip 30 and, according to this invention, is transported by transport mechanism 40 to a fuser assembly 60 where the marking particle image is fixed to the receiver member by application of heat and/or pressure. As will be discussed below, the fuser assembly 60 provides for selectable image quality and gloss. After fixing the image to the receiver member with the desired quality and gloss, the receiver member is then selectively transported to return to the transfer nip 30 to have a second side (duplex) image transferred to such receiver member, to a remote output tray 34 for operator retrieval, or to an output accessory (not shown) such as a sorter or stapler for example.

Appropriate sensors (not shown) of any well known type, such as mechanical, electrical, or optical for example, are utilized in the reproduction apparatus 10 to provide control signals for the apparatus. Such sensors are located along the receiver member travel path and are associated with the primary image forming member photoconductive drum 12, the intermediate image transfer member drum 20, the transfer backing member roller 32, and various image processing stations. As such, the sensors detect the location of a receiver member in its travel path, and the position of the primary image forming member photoconductive drum 12 in relation to the image forming processing stations, and respectively produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

The fuser assembly 60, according to this invention, includes a first fusing device 60*a* of the type which provides low gloss image reproductions on receiver members, and a substantially independent second fusing device 60*b* of the type which provides high gloss image reproductions on receiver members. The fusing devices 60*a* and 60*b* are, in and of themselves, well known.

For example, the first fusing device 60*a* may include a fusing roller 62 having a rubber outer layer on a hollow heat conductive core such as aluminum or steel. A lamp 64, located internally of the core of the fusing roller 62, provides the necessary heat required to at least soften a marking particle image on the receiver member to fuse the marking particle image thereto. An oilier mechanism 68 is located in operative association with the fusing roller 62 to apply a release oil coating to the roller. Such release oil coating will serve to inhibit the sticking of marking particles to the fusing roller. A pressure roller 66, having a hard surface, is located in nip relation with the fusing roller 62. An actuator cam 72 selectively applies a force to create a pressure in the nip to effect the fusing of the marking particle image to the receiver member. A cleaning mechanism 70*a* engages the fusing roller 62 to clean the surface thereof, and a similar cleaning mechanism 70*b* engages the pressure roller to clean the surface thereof.

The second fusing device 60*b* may include a heated roller 74 and a steering roller 76 located in spaced relation to the heater roller. A belt 78, having a smooth surface, is entrained about the heated roller 74 and the steering roller 76. The belt is transported in a closed loop path about the heated roller and steering roller, with the steering roller being castered and/or gimbaled to assure proper tracking of the belt as it moves about the closed loop path. A cooling mechanism 80 (shown schematically in the drawings) is located within the closed loop path of the belt 78, and cools the belt, and a receiver member attracted thereto, as the belt moves away from the heated roller 74. A pressure roller 82 is located in nip relation with the belt 78 as it passes about the heated roller 74.

The transport mechanism 40, according to this invention, includes a first transport 40*a* and a second transport 40*b*. The first transport 40*a*, located adjacent to the transfer nip 30, has an air permeable belt 84 entrained about a closed loop path defined by a plurality of rollers 86*a*–86*d*. A vacuum plenum 88 associated with a run of the belt 84 serves to produce an air flow through the belt to tack a receiver member to the belt. The tacked receiver member thus travels with the belt 84 over the run as the belt moves about the closed loop path. Similarly, the second transport 40*b* has an air permeable belt 90 entrained about a closed loop path defined by a plurality of rollers 92*a*–92*d*. A vacuum plenum 94 associated with a run of the belt 90 serves to produce an air flow through the belt to tack a receiver member to the belt. The tacked receiver member thus travels with the belt 90 over the run as the belt moves about the closed loop path. The second transport 40*b* is located with one end adjacent to the first transport 40*a* so as to accept a transported receiver member therefrom. The roller 92*a* of the second transport 40*b* is pivotably mounted on a fixed shaft 96. Accordingly, the second transport can be selectively pivoted, by appropriate actuation of a reversible motor (schematically shown and designated generally by the letter M), about the fixed shaft 96 to a first position (see FIG. 2) where a transported receiver member is directed to the first fusing device 60*a*, or to a second position (see FIG. 3) where a transported receiver member is directed to the second fusing device 60*b*.

Figure 2:
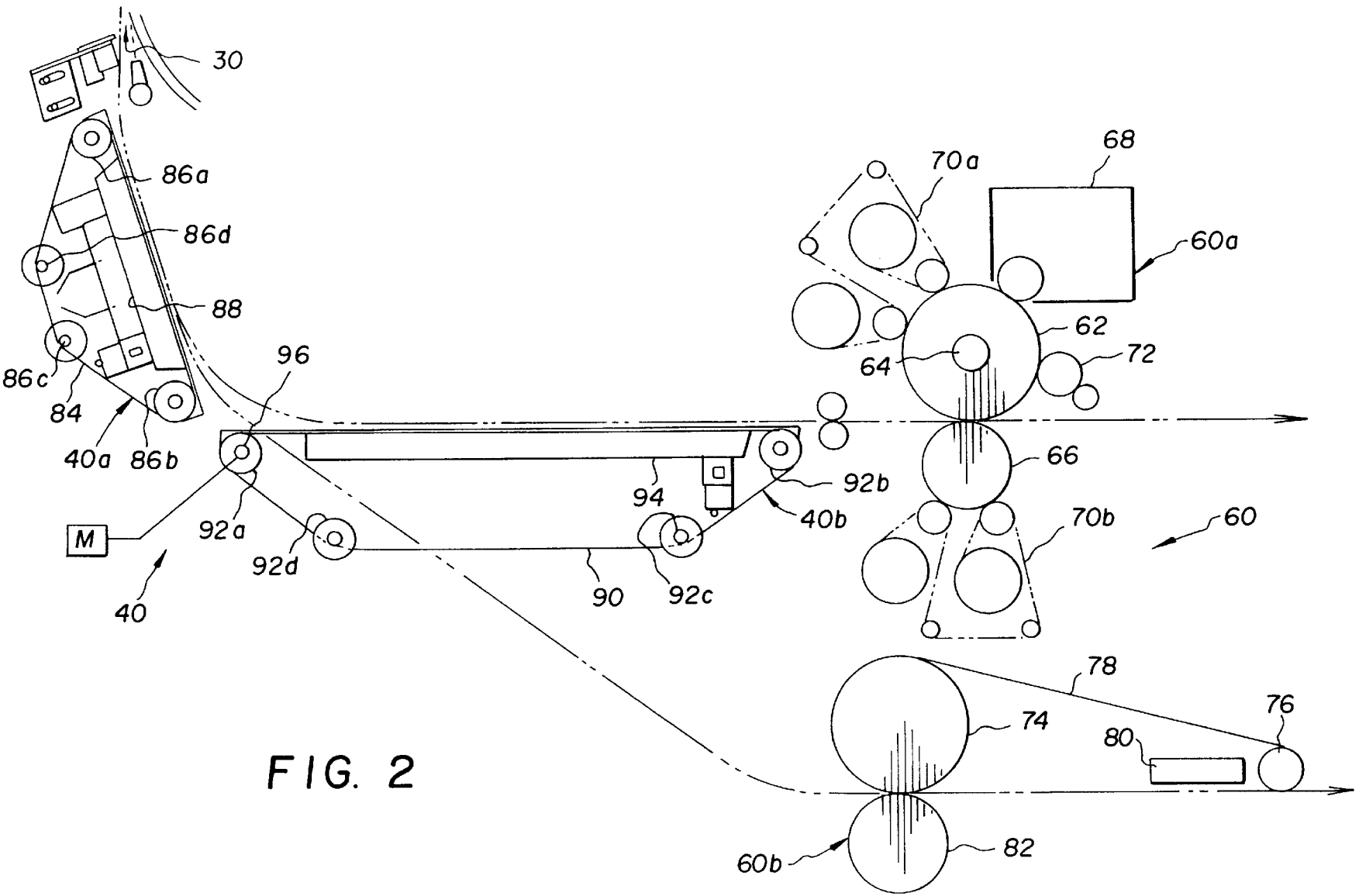
FIGS. 2 and 3 are a front elevational view, on an enlarged scale, of the fuser assembly, according to this invention, of the reproduction apparatus shown in FIG. 1.

With the described reproduction apparatus 10 image quality and gloss may be selectively tailored for desired results dependent upon image content and the type of receiver member which is to be used. For example, with a black image to be reproduced on a non-coated receiver member, the logic and control unit L produces an appropriate signal to select a desired supply hopper ($S_1$ or $S_2$) containing a particular supply of non-coated sheets of paper. The developer units for all but the black marking particles (unit 16*b*) are turned off, and the motor M is actuated to locate the second transport 40*b* of the transport mechanism 40 in the position relative to the first fusing device 60*a* as shown in FIGS. 1 and 2. Accordingly, during operation of the reproduction apparatus 10, the latent image charge pattern formed by the laser 15 on the drum 12 is developed only with black marking particles. Such developed image is then transferred to the intermediate transfer drum 20 and then to the a non-coated sheet of paper delivered to the transfer nip 30 from the selected supply hopper. After transfer of the black image to the non-coated paper, the second transport 40*b* of the transport mechanism 40 delivers the paper to the first fusing device 60*a* (the roller fuser), where a low gloss finish is imparted to the black image on the non-coated paper.

Figure 3:
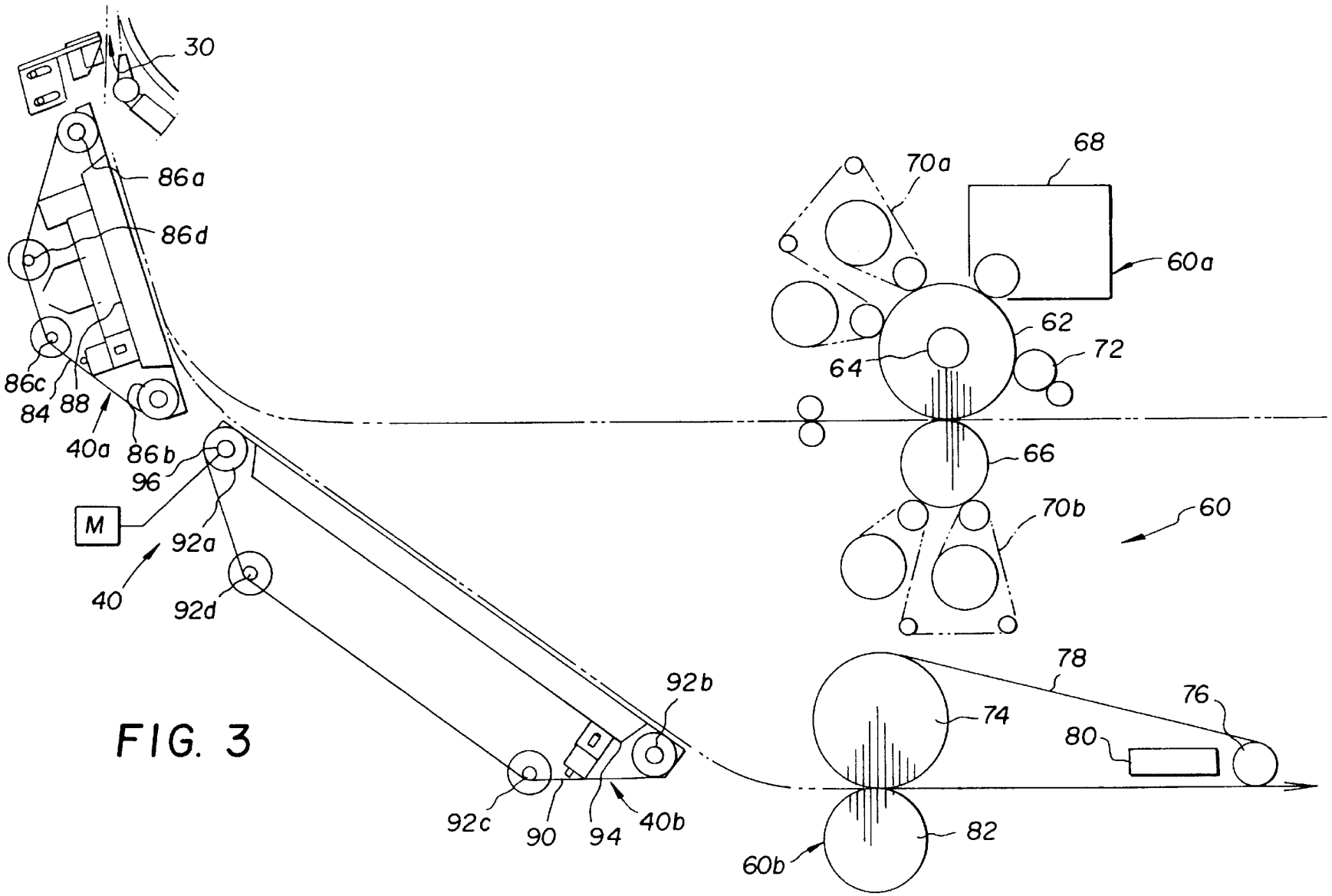

As another example, with a multi-color image to be reproduced on a coated receiver member, the logic and control unit L produces an appropriate signal to select a desired supply hopper ($S_1$ or $S_2$) containing a particular supply of clay or resin coated sheets of paper. The developer units are all turned on, and the motor M is actuated to locate the second transport 40*b* of the transport mechanism 40 in the position relative to the second fusing device 60*b* as shown in FIG. 3. During operation of the reproduction apparatus 10, first the developer unit 16*c*1 lays down a full page layer of clear marking particles on the intermediate transfer drum 20. Thereafter, color separation latent image charge patterns formed by the laser 15 on the drum 12 are developed with respective color marking particles and transferred in superposed registration to the intermediate transfer drum 20 (already bearing the clear marking particle layer). Then the combination marking particle image is transferred to a coated sheet of paper delivered to the transfer nip 30 from the selected supply hopper. After transfer of the multicolor image with the clear overcoat to the coated paper, the second transport 40*b* of the transport mechanism 40 delivers the paper to the second fusing device 60*b* (the belt fuser), where a high gloss finish is imparted to the image. The clear marking particles may be made with suitable additives to help with marking particle release from the transfer drum 20 or the fusing device 60*b* (i.e., prevent the above discussed offset phenomenon) and to enhance keeping properties of the reproduction on the receiver member. Further, the clear marking particle layer forms an overcoat which will substantially reduce image relief, and will produce a more uniform gloss appearance.

Of course, other combinations of operation are possible with the reproduction apparatus according to this invention.

For example, a multi-color image requiring reduced gloss may be reproduced on a non-coated receiver member and without a coating of the clear marking particles. On the otherhand, the clear marking particles may be utilized to prevent offset of thin line or typed text images.

The invention has been described in detail with particular reference to certain preferred embodiments thereof, but it will be understood that variations and modifications can be effected within the spirit and scope of the invention.

PARTS LIST

| | | | |
|---|---|---|---|
| 10. | Electrostatographic reproduction apparatus | 66. | Pressure roller |
| 12. | Drum | 68. | Oiler |
| 14. | Corona charging device | 70a. | Fuser roller cleaning mechanism |
| 15. | Laser | 70b. | Pressure roller cleaning mechanism |
| 16. | Development station | 72. | Actuating Cam |
| 16y. | Yellow developer unit | 74. | Heated roller |
| 16m. | Magneta developer unit | 76. | Steering roller |
| 16c. | Cyan developer unit | 78. | Belt |
| 16b. | Black developer unit | 80. | Cooling device |
| 16cl. | Clear developer unit | 82. | Pressure roller |
| 20. | Intermediate transfer drum | 84. | Belt |
| 30. | Nip | 86a–d. | Rollers |
| 32. | Transfer backing member roller | 88. | Vacuum plenum |
| 34. | Output tray | 90. | Belt |
| 40. | Transport mechanism | 92a–d. | Rollers |
| 40a. | First transport | 94. | Vacuum plenum |
| 40b. | Second transport | 96. | Fixed shaft |
| 60. | Fuser assembly | L. | Logic and control unit |
| 60a. | First fusing device | $S_1$. | Supply hopper |
| 62. | Fusing roller | $S_2$. | Supply hopper |
| 64. | Heater lamp | | |

What is claimed is:

1. A reproduction apparatus providing for selectable image quality and gloss, said reproduction apparatus comprising:

a dielectric member adapted to have latent images formed thereon;

a development station, including a plurality of developer units respectively containing marking particles of different colors, at least one developer unit containing black marking particles and another developer unit containing clear marking particles, said development station selectively developing latent images on said dielectric member with marking particles from said developer units respectively;

a transfer station for transferring developed marking particle images from said dielectric member to a receiver member;

a fuser assembly including a first fusing device for fusing a marking particle image on a receiver member so as to produce a low gloss image on said receiver member, and a second independent fusing device for fusing a marking particle image on a receiver member so as to produce a high gloss image on said receiver member;

a transport, in juxtaposition with said transfer station, selectively communicating with said first fusing device or said second fusing device; and a logic and control unit for selectively activating said developer unit for applying clear marking particles to a receiver member, and for activating said transport to deliver a receiver member from said transfer station to said first or second fusing device dependent upon the desired quality and gloss of an image fused on a receiver member.

2. The reproduction apparatus of claim 1 wherein said first fusing device includes a heated fuser roller, and a pressure roller in nip relation with said fuser roller.

3. The reproduction apparatus of claim 2 wherein said first fusing device further includes a web cleaner in operative association with said pressure roller.

4. The reproduction apparatus of claim 1 wherein said second fusing device includes a heated roller, a steering roller spaced remote from said heated roller, and a web entrained about said heated roller and said steering roller to establish a closed loop path for said web.

5. The reproduction apparatus of claim 4 wherein said second fusing device further includes means for cooling said web at the portion thereof adjacent to said steering roller.

6. The reproduction apparatus of claim 4 wherein said second fusing device further includes a pressure roller forming a nip relation with said heated roller through said web.

7. The reproduction apparatus of claim 1 wherein said first fusing device includes a heated fuser roller, and a pressure roller in nip relation with said fuser roller, and wherein said second fusing device includes a heated roller, a steering roller spaced remote from said heated roller, and a web entrained about said heated roller and said steering roller to establish a closed loop path for said web.

8. The reproduction apparatus of claim 7 wherein said second fusing device further includes means for cooling said web at the portion thereof adjacent to said steering roller.

9. The reproduction apparatus of claim 1 wherein said transport includes a belt assembly pivotable about an axis located in fixed relation with said transfer station.

10. The reproduction apparatus of claim 9 wherein said transport is movable such that the end thereof opposite from said fixed axis is selectively located adjacent to said nip of said first fusing device or said heated roller of said second fusing device.

11. In a reproduction apparatus including a dielectric member adapted to have latent images formed thereon, a development station, including a plurality of developer units respectively containing marking particles of different colors, at least one developer unit containing black marking particles and another developer unit containing clear marking particles, said development station selectively developing latent images on said dielectric member with marking particles from said developer units respectively, and a transfer station for transferring developed marking particle images from said dielectric member to a receiver member, a device providing for selectable image quality and gloss, said device comprising:

a fuser assembly including a first fusing device for fusing a marking particle image on a receiver member so as to produce a low gloss image on said receiver member, and a second independent fusing device for fusing a marking particle image on a receiver member so as to produce a high gloss image on said receiver member;

a transport, in juxtaposition with said transfer station, selectively communicating with said first fusing device or said second fusing device; and a logic and control unit for selectively activating said developer unit for applying clear marking particles to a receiver member, and for activating said transport to deliver a receiver member from said transfer station to said first or second fusing device dependent upon the desired quality and gloss of an image fused on a receiver member.

12. In a reproduction apparatus including a dielectric member adapted to have latent images formed thereon, a development station, including a plurality of developer units respectively containing marking particles of different colors, at least one developer unit containing black marking particles and another developer unit containing clear marking particles, said development station selectively developing latent images on said dielectric member with marking particles from said developer units respectively, and a transfer station for transferring developed marking particle images from said dielectric member to a receiver member, a method for providing selectable image quality and gloss, said method comprising the steps of:

selecting fusing a marking particle image on a receiver member so as to produce a low gloss image on said receiver member, or fusing a marking particle image on a receiver member so as to produce a high gloss image on said receiver member;

depending upon such selection, transporting a receiver member to a first fusing device or a second independent fusing device; and controlling selective activation of said developer unit for applying clear marking particles to a receiver member, and for activating said transport to deliver a receiver member from said transfer station to said first or second fusing device dependent upon the desired quality and gloss of an image fused on a receiver member.

* * * * *